US006049044A

United States Patent [19]

Mizobuchi

[11] Patent Number: 6,049,044

[45] Date of Patent: Apr. 11, 2000

[54] MULTIPLE OPERATION TYPE ELECTRICAL PART

[75] Inventor: Shinichi Mizobuchi, Miyagi-ken, Japan

[73] Assignee: ALPS Electric Co., Ltd., Tokyo, Japan

[21] Appl. No.: 09/309,062

[22] Filed: May 10, 1999

[30] Foreign Application Priority Data

May 25, 1998 [JP] Japan ..... 10-142847

[51] Int. Cl.[7] ..... H01H 9/00

[52] U.S. Cl. ..... 200/4; 200/11 R; 200/18

[58] Field of Search ..... 200/4, 11 R–11 K, 200/14, 16 R–16 C, 17 R, 18, 564, 336, 5 R, 61, 27, 61.54

[56] References Cited

U.S. PATENT DOCUMENTS 2,781,425 2/1957 Glowzinski et al. ..... 200/4
5,075,519 12/1991 Hayakawa ..... 200/61.54
5,436,413 7/1995 Katakami ..... 200/14
5,665,946 9/1997 Nishijima et al. ..... 200/4
5,847,335 12/1998 Sugahara et al. ..... 200/4

FOREIGN PATENT DOCUMENTS 9-171901 12/1965 Japan ..... H01C 1/01

*Primary Examiner*—Michael Friedhofer
*Attorney, Agent, or Firm*—Brinks, Hofer, Gilson & Lione

[57] ABSTRACT

A multiple operation type electrical part which is made very small in the axial direction as a result of using the space of a recess at the center portion of a first rotary member to prevent dislodgment of an inner shaft. Conventional multiple operation type electrical parts are large in the axial direction. They are large because dislodgment of the inner shaft is achieved by passing the inner shaft through five cases and an insulating plate, and by using the space in a case at the rearmost part of the electrical part. The multiple operation type electrical part of the invention makes it possible to overcome this problem present in conventional multiple operation type electrical parts.

5 Claims, 15 Drawing Sheets

MULTIPLE OPERATION TYPE ELECTRICAL PART

BACKGROUND OF THE INVENTION

1. Field of the Invention

The present invention relates to a multiple operation type electrical part suitable for use in operating, for example, a car stereo.

2. Description of the Related Art

A description will now be given of a conventional multiple operation type electrical part with reference to FIG. 30. The bearing 51 comprises an axial portion 51*b*, with a through hole 51*a* formed therein, and a flange 51*c*. A cylindrical outer shaft 52 is rotatably mounted in the through hole 51*a* of the bearing 51.

The cylindrical sleeve 53, fitted to the rear side of the outer shaft 52, is affixed to the outer shaft 52 by caulking the sleeve 53 from the outer side thereof.

The case 54, which is a zinc die-casting or the like, has a recess 54*a* having accommodated therein a self-returning coil spring 55. With the arm portion 55*a* retained by the side wall of the case 54, the coil spring 55 is mounted to the case 54.

The case 54, having the coil spring 55 mounted thereto, is disposed on the rear side of the flange 51*c* of the bearing 51. When the case 54 is disposed in this manner, the sleeve 53 is disposed so as to be placed within the wound portion 55*b* of the coil spring 55.

Clockwise or counterclockwise rotation of the outer shaft 52 causes rotation of the sleeve 53.

The rotation of the sleeve 53 causes movement of one of the arms 55*a* of the coil spring 55 in opposition to the resiliency of the arm 55*a*.

When the outer shaft 52 is released so that rotational force is longer applied thereto, the springy arm 55*a*, which has been moved, bumps into the side wall of the case 54 due to its resiliency, whereby the outer shaft 52 and the sleeve 53 rotate until they return to their original positions and stop there. Accordingly, the outer shaft 52 and the sleeve 53 are self-returning component parts capable of returning to their original positions by themselves.

A sliding member 57, formed of a springy metallic plate, is mounted to a rotary member 56, which is a molded product of synthetic resin. With the sleeve 53 fitted into a hole at the center portion of the rotary member 56, the rotary member 56 is mounted on the rear side of the case 54, so that it rotates as the sleeve 53 rotates.

The case 58, which is a molded product of synthetic resin, has a recess 58*a*. A contact member 59 is embedded in the case 58 so as to be exposed at the bottom portion of the recess 58*a*.

With the rotary member 56 accommodated in the recess 58*a*, the case 58 is disposed on the rear side of the case 54.

When the case 58 is disposed in this manner, the sliding member 57 can come into contact with and separate from the contact member 59. When the rotary member 56 rotates as a result of the rotation of the outer shaft 52, the sliding member 57 rotates in order to come into contact with or separate from the contact member 59, whereby a switching operation takes place.

The rotary member 56, having the sliding member 57 mounted thereto, and the case 58, having the contact member 59 mounted thereto, form a first rotary electrical part D4.

The inner shaft 60 is inserted into a hole of the outer shaft 52 in such a manner as to protrude from the rear side of the case 58, and is mounted in the hole so as to be rotatable and axially movable.

The case 61, which is a molded product of synthetic resin, has a bottom wall 61*a*, being a recessed portion, and a bumpy portion 61*b*, formed at the bottom wall 61*a*. With the inner shaft 60 inserted in a hole of the case 61, the case 61 is disposed on the rear side of the case 58.

The rotary member 62, which is a molded product of synthetic resin, has an axial portion 62*a* and a flange 62*b*. A clicking member 63, formed of a spring plate, is mounted at the front side of the flange 62*b* of the rotary member 62.

The case 64, which is a molded product of synthetic resin, has a recess 64*a*, at the center portion thereof, and a hole 64*b*, connected to the recess 64*a*. With the rotary member 62 accommodated in the recess 64*a*, the axial portion 62*a* of the rotary member 62 is fitted to the hole 64*b*, whereby the rotary member 62 is rotatably supported by the case 64.

With the rotary member 62 being inserted in the case 64 and the inner shaft 60 of the rotary member 62 being joined to the axial portion 62*a* of the rotary member 62 through splines, the case 64 is disposed on the rear side of the case 61.

When the case 64 is disposed in this manner, the clicking member 63 can engage and disengage the bumpy portion 61*b* of the case 61. Rotation of the inner shaft 60 causes rotation of the rotary member 62. This causes the clicking member 63 to engage and disengage the bumpy portion 61*b* in order to provide a tactile feel when the inner shaft 60 is rotated.

The case 61, the rotary member 62, having the clicking member 63 mounted thereto, and the case 64 form a click mechanism K.

The rotary member 65, which is a molded product of synthetic resin, has an axial portion 65*a* and a flange 65*b*, with a movable contact 66 being embedded in and mounted to the flange 65*b*.

The case 67, which is a molded product of synthetic resin, has a hole 67*a* and a recess 67*b*, with a sliding member 68, formed of a springy metallic plate, being embedded in and mounted to the case 67.

With the rotary member 65 being accommodated in the recess 67*b*, the axial portion 65*a* of the rotary member 65 is fitted into the hole 67*a*, whereby the rotary member 65 is rotatably supported by the case 67.

With the rotary member 65 being inserted in the case 67 and the inner shaft 60 being joined to the axial portion 65*a* of the rotary member 65 through splines, the case 67 is disposed on the rear side of the case 64.

When the case 67 is disposed on the rear side of the case 64, the sliding member 68 can come into contact with and separate from the movable contact 66. Rotation of the rotary member 65 as a result of the rotation of the inner shaft 60 causes the movable contact 66 to rotate and come into contact with and separate from the sliding member 68, whereby switching operations are performed.

The rotary member 65, to which the movable contact 66 is mounted, and the case 67, to which the sliding member 68 is mounted, form a second rotary electrical part D5.

With the inner shaft 60 being inserted in a hole formed in the center portion of an insulating plate 69, the insulating plate 69, formed of insulating material, is disposed on the rear side of the case 67.

A dislodgment preventing plate 70 is mounted to the inner shaft 60, projecting from the rear side of the insulating plate 69, in order to prevent the inner shaft 60 from being dislodged towards the front.

An actuating member 72 is mounted to the fixed member 71, being a molded product of synthetic resin. With the actuating member 62 being in contact with one end of the inner shaft 60, the fixed member 71 is fitted to the protrusion and the recess of the case 67 so as to be disposed on the rear side of the case 67.

The case 73, which is a molded product of synthetic resin, has a recess 73*a* and a bottom wall 73*b*, with contact members 74 and 75, exposed at the bottom wall 73*b*, being embedded in and mounted to the case 73.

The movable contact 76, formed of a springy metallic plate, is dish-like in shape and has a concavely formed center portion. It is accommodated in the recess 73*a* of the case 73. The center portion of the movable contact 76 is separated from the contact member 74, and the peripheral portions thereof are mounted to the contact member 75 so as to be normally in contact therewith.

With the fixed member 71 and the actuating member 72 being accommodated in the recess 73*a*, the case 73 is disposed on the rear side of the insulating plate 69.

When the case 73 is disposed in this manner, the center portion of the movable contact 76 comes into contact with the actuating member 72. The resiliency of the movable contact 76 causes the actuating member 72 and the inner shaft 60 to be normally pushed towards the front, so that the plate 70 is pushed against the insulating plate 69.

When the inner shaft 60 is pushed rearwards in the axial direction thereof, causing the actuating member 72 to move in the same direction, the center portion of the movable contact 76 is pushed in opposition to its resiliency, and comes into contact with the contact member 74. This renders the contact members 74 and 75 conductive, turning on a push switch S. When the inner shaft 60 is released, the resiliency of the movable contact 76 causes the actuating member 72 and the inner shaft 60 to return to their original positions. This causes the movable contact 76 to separate from the contact member 74, whereby the push switch S is turned off.

The case 73, to which the contact members 74 and 75 are mounted, and the movable contact 76 form the push switch S.

The cover 77, which is a molded product of synthetic resin, is disposed on the rear side of the case 73 in order to prevent entry of dust or the like into the case 73.

As described above, the bearing 51 and the cover 77 and the various component parts disposed therebetween are disposed successively on their corresponding component parts. These component parts are integrally mounted using a mounting plate (not shown).

A description will now be given of the operation of the multiple operation type electrical part having the above-described structure. When the outer shaft 52 is rotated clockwise or counterclockwise, the sleeve 53 and the rotary member 56 rotate at the same time. The sleeve 53 rotates in opposition to the resiliency of one of the arms 55*b* of the coil spring 55. The rotation of the rotary member 56 causes the sliding member 57, mounted to the rotary member 56, to rotate and come into contact with and separate from the contact member 59, whereby a switching operation is performed at the first rotary electrical part D4.

When the outer shaft 52 is released so that rotational force is no longer applied, the resiliency of the arm 55*b*, which has been moved, causes the sleeve 53 and the rotary member 56 to rotate back to their original positions, whereby the first rotary electrical part D4 returns to its original switching state. The rotary member 56 is a self-returning component part capable of returning to its original position by itself.

Clockwise or counterclockwise rotation of the inner shaft 60 causes rotation of the rotary member 62, joined to the inner shaft 60 through splines. This causes the clicking member 63, mounted to the rotary member 62, to engage and disengage the bumpy portion 61*b* of the case 61 in order to provide a tactile feel when the inner shaft 60 is rotated. This also causes the rotary member 65, joined to the inner shaft 60 through splines, to rotate. The rotation of the rotary member 65 causes the movable contact 66, provided at the rotary member 65, to rotate and come into contact with and separate from the sliding member 68, whereby a switching operation is performed at the second rotary electrical part D5.

When the inner shaft 60 is pushed rearward in the axial direction thereof, the actuating member 72 moves in the same direction to push the center portion of the movable contact 76 in opposition to the resiliency of the movable contact 76. This causes the center portion of the movable contact 76 to come into contact with the contact member 74, thereby rendering the contact members 74 and 75 of the push switch S conductive, and turning on the push switch S.

When the inner shaft 60 is released, the resiliency of the movable contact 76 causes the actuating member 72 and the inner shaft 60 to return to their original positions. This causes the movable contact 76 to separate from the contact member 74 and to turn off the push switch S.

Accordingly, the multiple operation type electrical part is operated in the above-described way.

The multiple operation type electrical part having the above-described structure is used in operating a car stereo. More specifically, the first rotary electrical part D4 is used for radio tuning. The second rotary electrical part D5 is used, for example, for volume or bass adjustments. The push switch S is used for switching, for example, volume or bass modes.

Since the various operations of the multiple operation type electrical part can be carried out at the operating portions concentrated at a particular area, the multiple operation type electrical part is used particularly in car stereos.

Dislodgment of the inner shaft 60 of the conventional multiple operation type electrical part is prevented by passing it through five cases, or cases 54, 58, 61, 64, and 67, and using the space in the case 73 at the rearmost portion of the multiple operation type electrical part. Therefore, the multiple operation type electrical part becomes very large in the axial direction thereof.

In addition, in order to move one of the arms 55*b* of the self-returning coil spring 55, a sleeve 53 needs to be formed separately of the rotary member 56, resulting in increased size of the multiple operation type electrical part.

SUMMARY OF THE INVENTION

In order to overcome the above-described problems, according to a basic form of the present invention, there is provided a multiple operation type electrical part comprising:

a rotatable cylindrical outer shaft;

a rotatable inner shaft inserted in the outer shaft, the inner shaft being movable in an axial direction thereof;

a first rotary electrical part comprising a first rotary member actuated by the rotational motion of the outer shaft;

a second rotary electrical part comprising a second rotary member actuated by the rotational motion of the inner shaft; and a push switch operated by the axial movement of the inner shaft;

wherein the first rotary member has at the center portion thereof a recess for inserting the inner shaft therein; and wherein the inner portion of the recess is used to prevent dislodgment of the inner shaft towards the front.

The multiple operation type electrical part may further comprise a dislodgment preventing member mounted to the inner shaft, the dislodgment preventing member being brought into contact with an inner wall defining the recess of the first rotary member in order to prevent dislodgment of the inner shaft towards the front.

In the multiple operation type electrical part, the portion where the outer shaft and the first rotary member are joined together is located in front of the portion where the dislodgment preventing member and the inner wall contact each other.

In the multiple operation type electrical part, the first rotary member may have a stepped bottom wall formed by forming an insertion hole connected to the recess and extending in an axial direction thereof, and the portion where the outer shaft and the first rotary member are joined together may be formed by retaining the outer shaft by the bottom wall.

In the multiple operation type electrical part, the first rotary member may comprise a rotary member with a movable contact and a linking member with the recess, and wherein the portion where the outer shaft and the first rotary member are joined together may be formed by joining the linking member to the outer shaft.

The multiple operation type electrical part may further comprise a self-returning coil spring provided at the outer periphery of the linking member, the coil spring having an arm which is moved by the rotary member in order to cause the outer shaft to return to its original position by itself.

DESCRIPTION OF THE PREFERRED EMBODIMENTS

Figure 1:
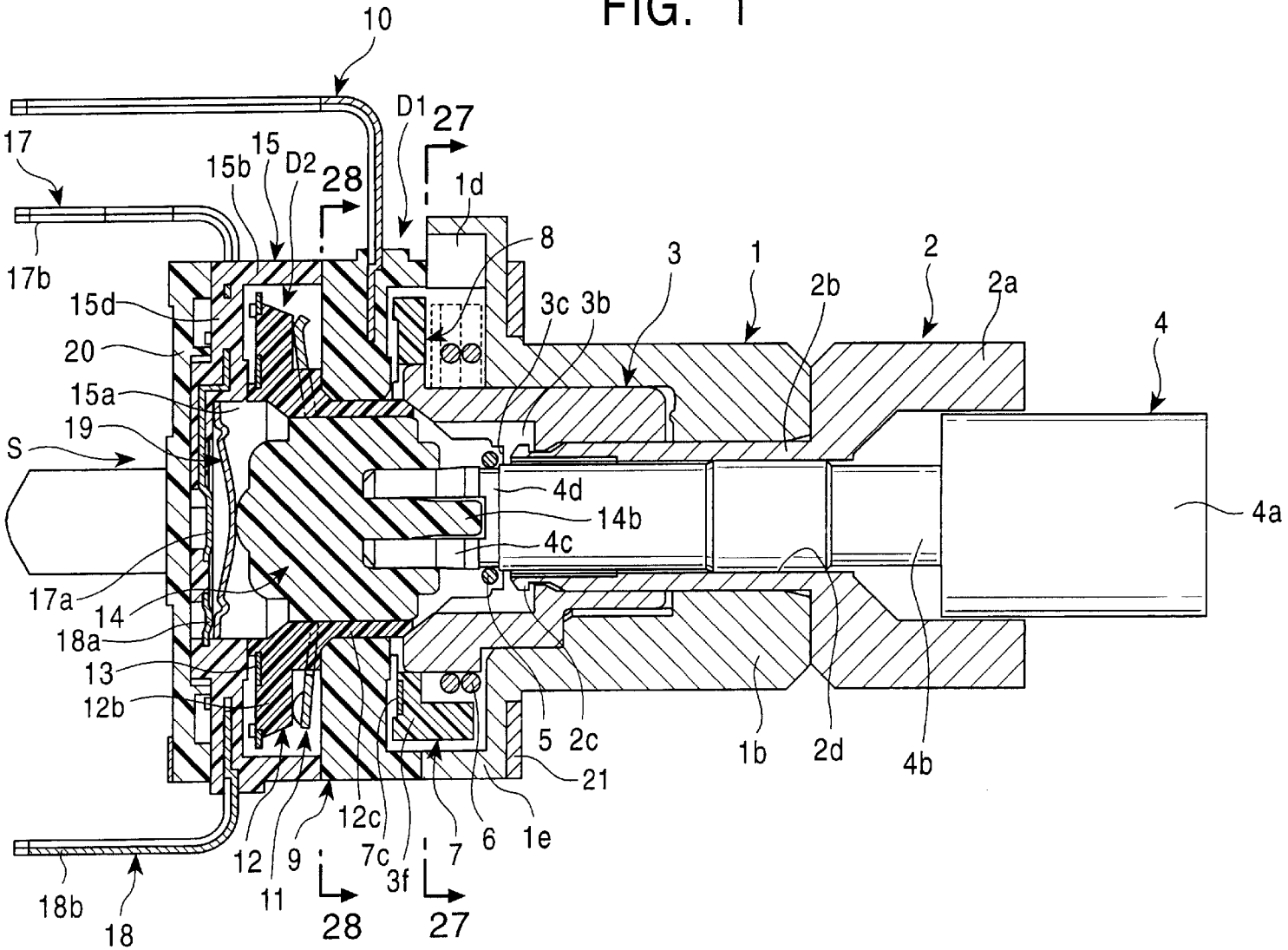
FIG. 1 is a sectional view of a multiple operation type electrical part in accordance with the present invention.
Figure 2:
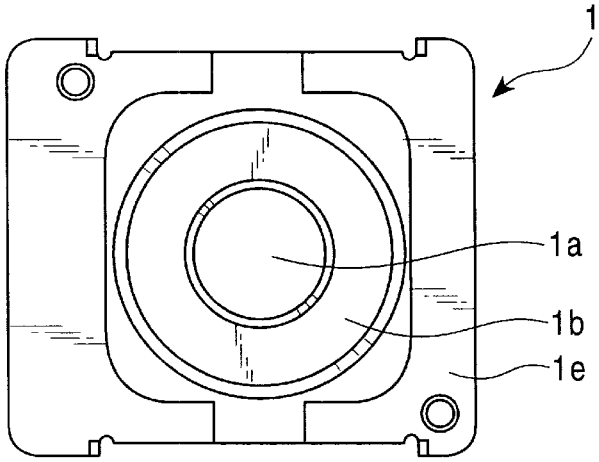
FIG. 2 is a plan view of the bearing of the multiple operation type electrical part in accordance with the present invention.
Figure 3:
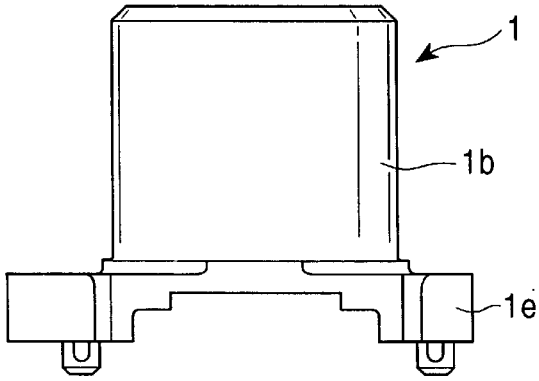
FIG. 3 is a side view of the bearing of the multiple operation type electrical part in accordance with the present invention.
Figure 4:
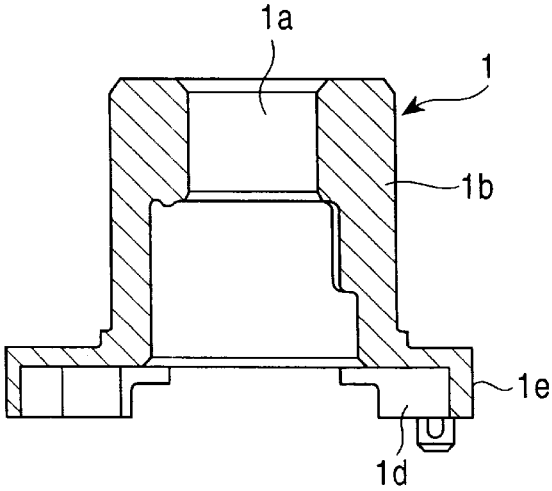
FIG. 4 is a sectional view of the bearing of the multiple operation type electrical part in accordance with the present invention.
Figure 5:
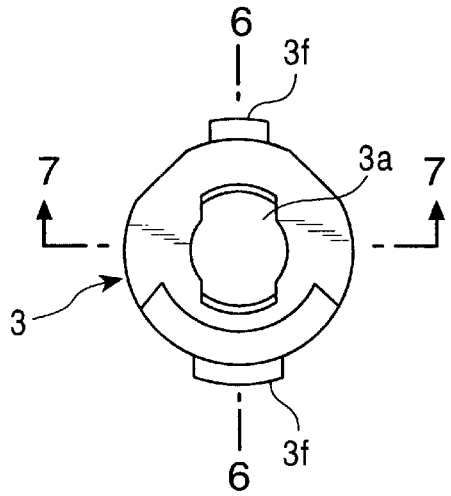
FIG. 5 is a plan view of the linking member of the multiple operation type electrical part in accordance with the present invention.
Figure 6:
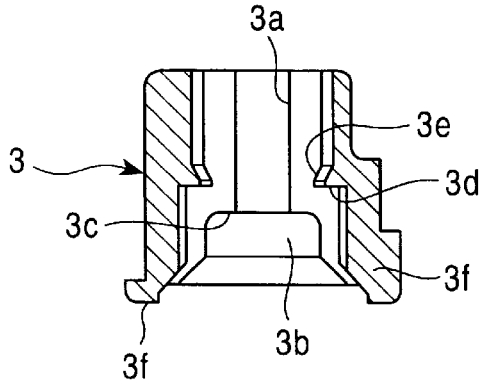
FIG. 6 is a sectional view taken along line 6—6 of FIG. 5.
Figure 7:
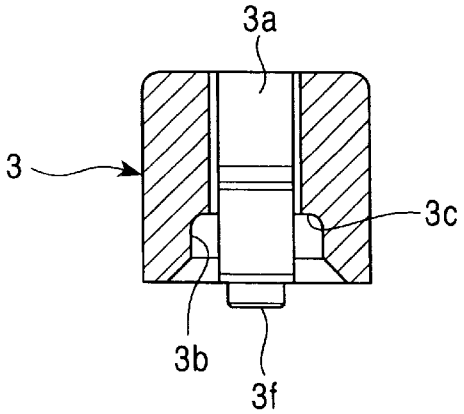
FIG. 7 is a sectional view taken along line 7—7 of FIG. 5.
Figure 8:
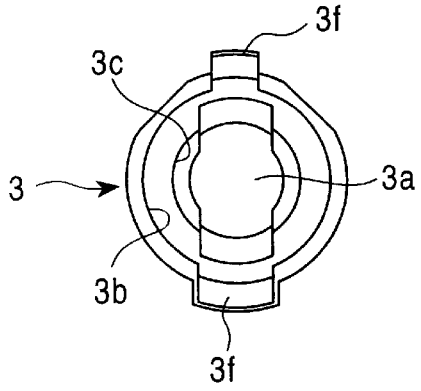
FIG. 8 is a bottom view of the linking member of the multiple operation type electrical part in accordance with the present invention.
Figure 9:
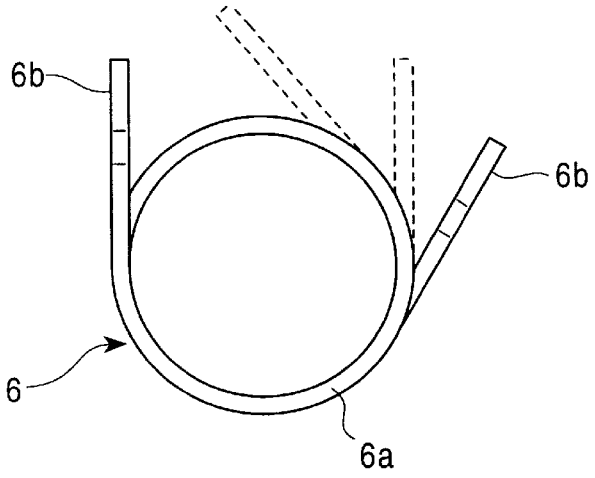
FIG. 9 is a plan view of the coil spring of the multiple operation type electrical part in accordance with the present invention.
Figure 10:
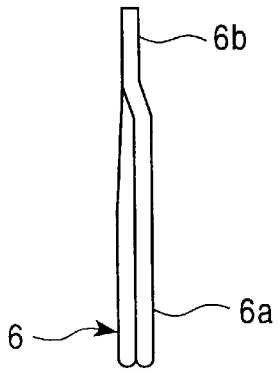
FIG. 10 is a side view of the coil spring of the multiple operation type electrical part in accordance with the present invention.
Figure 11:
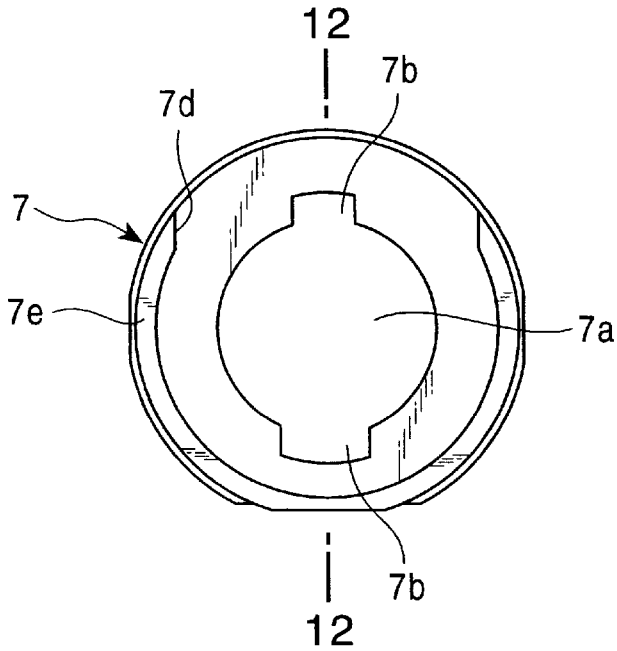
FIG. 11 is a plan view of the rotary member of the multiple operation type electrical part in accordance with the present invention.
Figure 12:
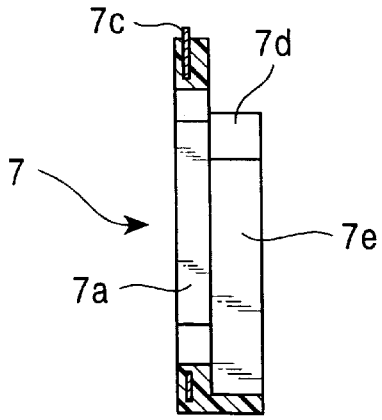
FIG. 12 is a sectional view taken along line 12—12 of FIG. 11.
Figure 13:
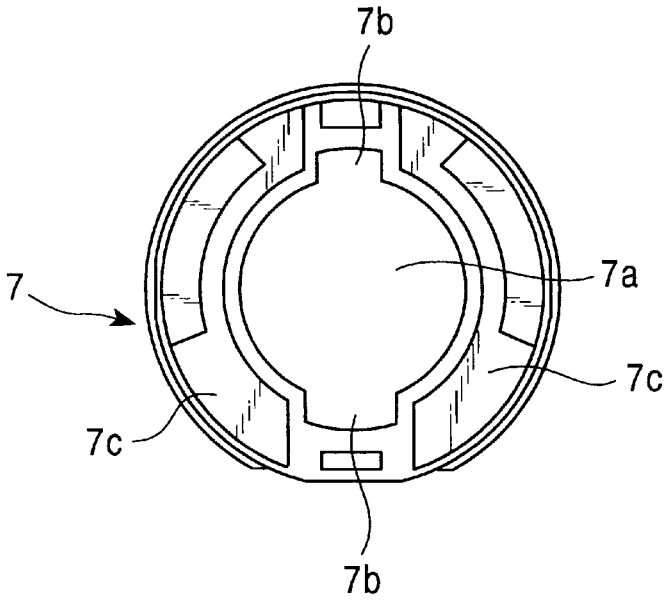
FIG. 13 is a bottom view of the rotary member of the multiple operation type electrical part in accordance with the present invention.
Figure 14:
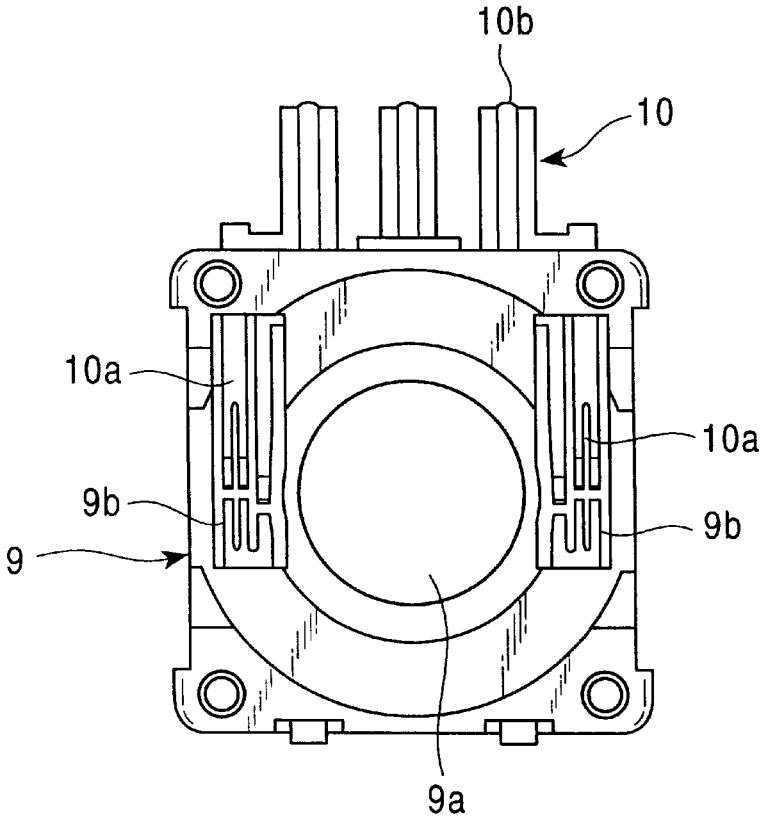
FIG. 14 is a plan view of the insulating base member of the multiple operation type electrical part in accordance with the present invention.
Figure 15:
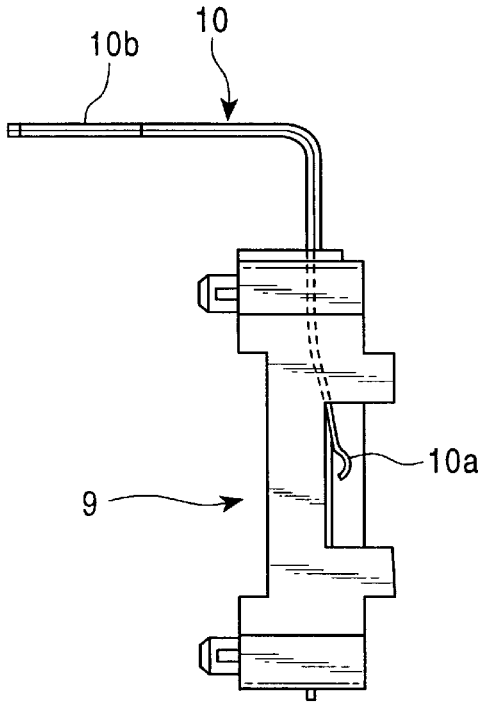
FIG. 15 is a side view of the insulating base member of the multiple operation type electrical part in accordance with the present invention.
Figure 16:
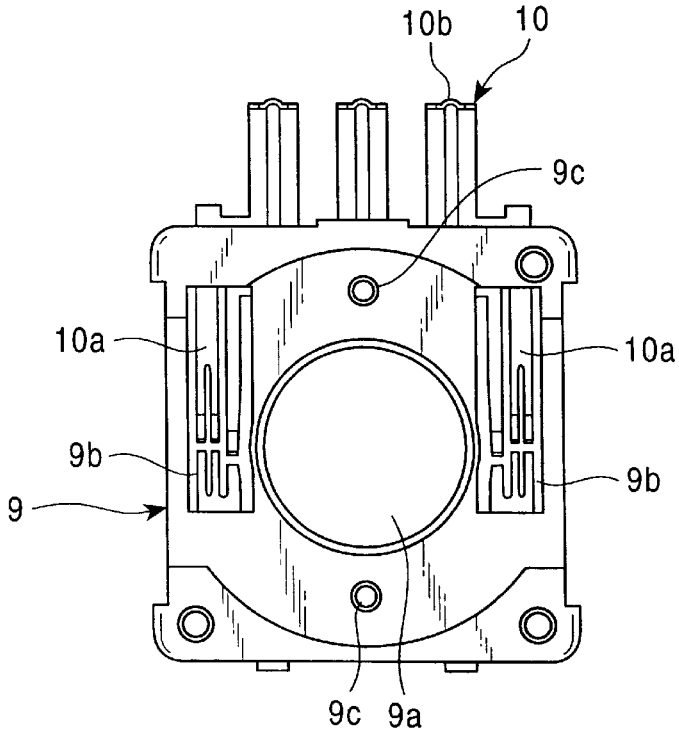
FIG. 16 is a bottom view of the insulating base member of the multiple operation type electrical part in accordance with the present invention.
Figure 17:
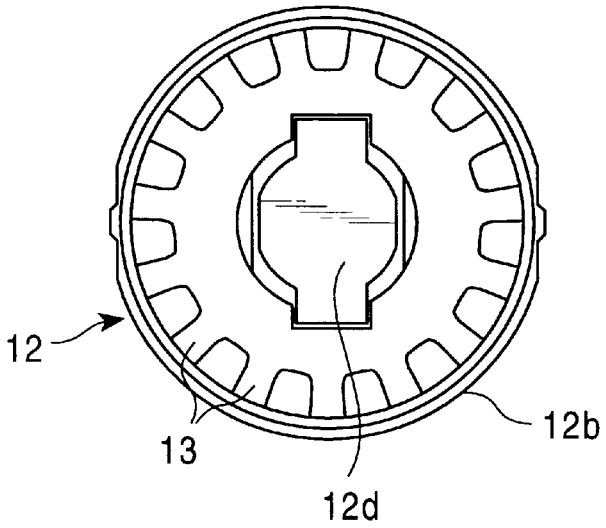
FIG. 17 is a plan view of the second rotary member of the multiple operation type electrical part in accordance with the present invention.
Figure 18:
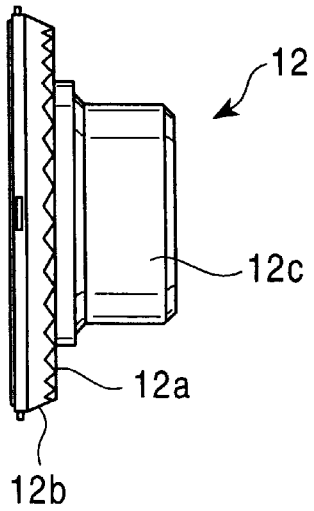
FIG. 18 is a side view of the second rotary member of the multiple operation type electrical part in accordance with the present invention.
Figure 19:
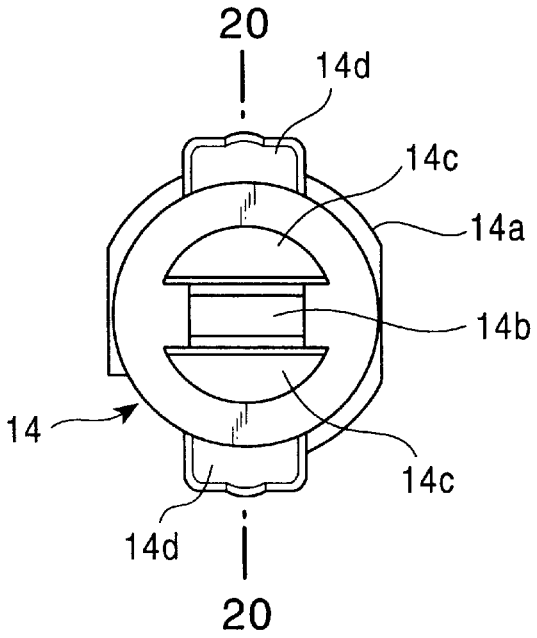
FIG. 19 is a plan view of the actuating member of the multiple operation type electrical part in accordance with the present invention.
Figure 20:
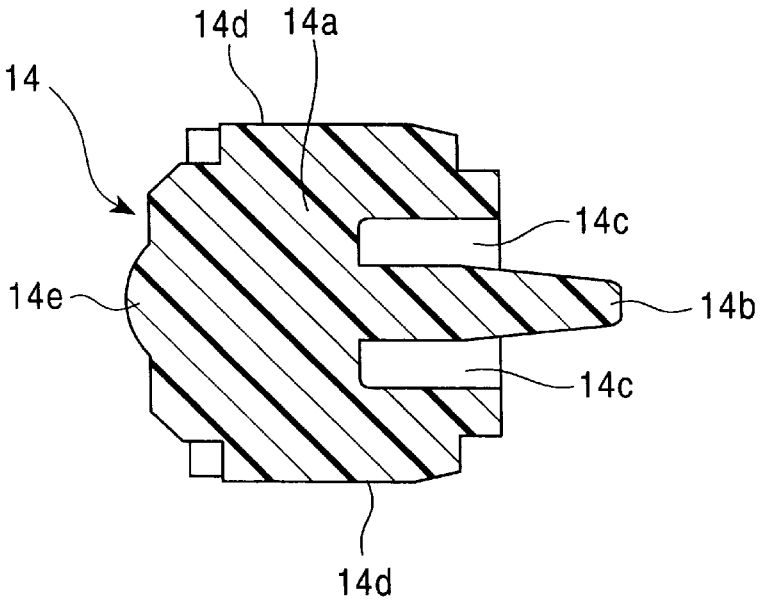
FIG. 20 is a sectional view of the actuating member of the multiple operation type electrical part in accordance with the present invention.
Figure 21:
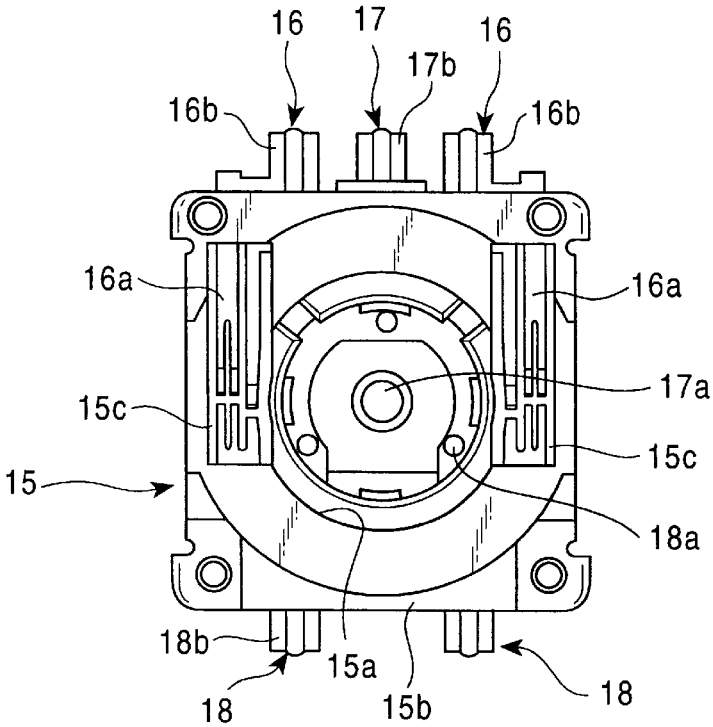
FIG. 21 is a plan view of the insulating case of the multiple operation type electrical part in accordance with the present invention.
Figure 22:
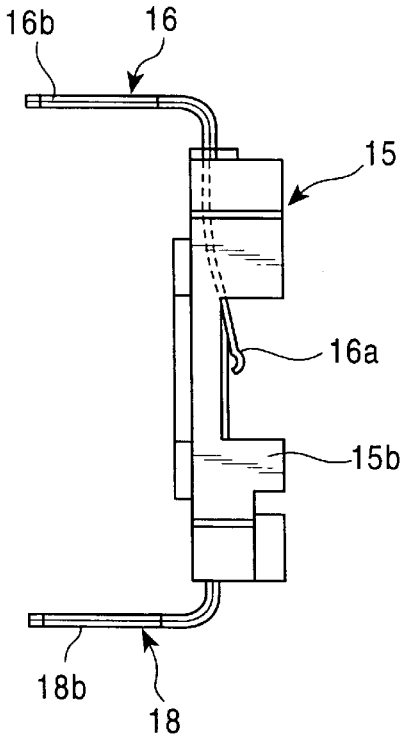
FIG. 22 is a side view of the insulating case of the multiple operation type electrical part in accordance with the present invention.
Figure 23:
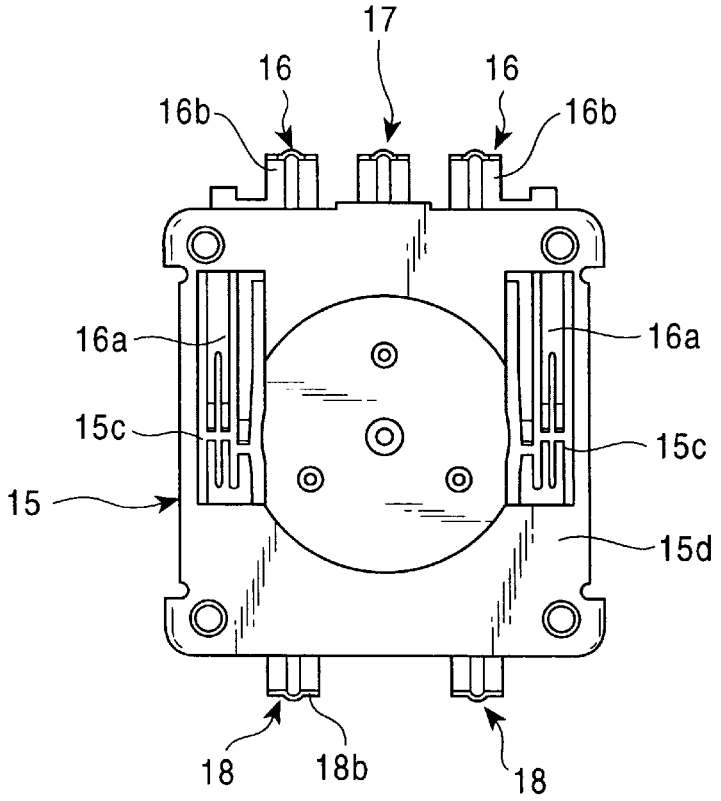
FIG. 23 is a bottom view of the insulating case of the multiple operation type electrical part in accordance with the present invention.
Figure 24:
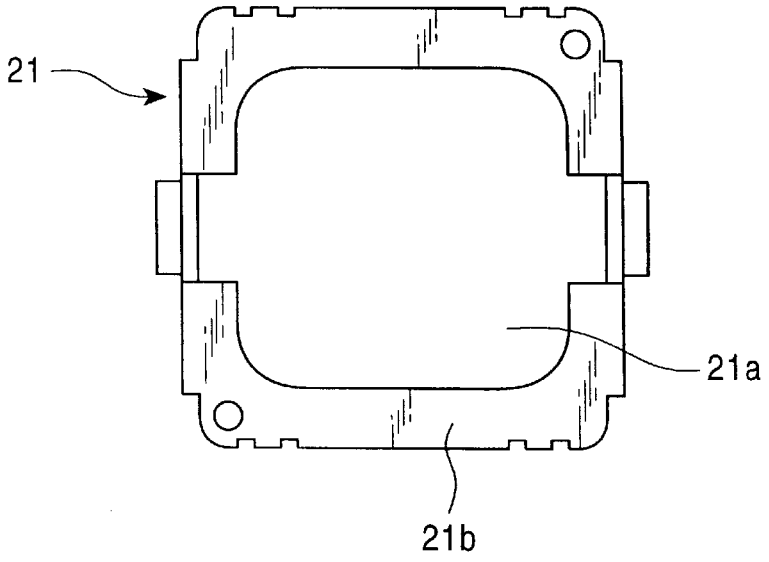
FIG. 24 is a plan view of the mounting plate of the multiple operation type electrical part in accordance with the present invention.
Figure 25:
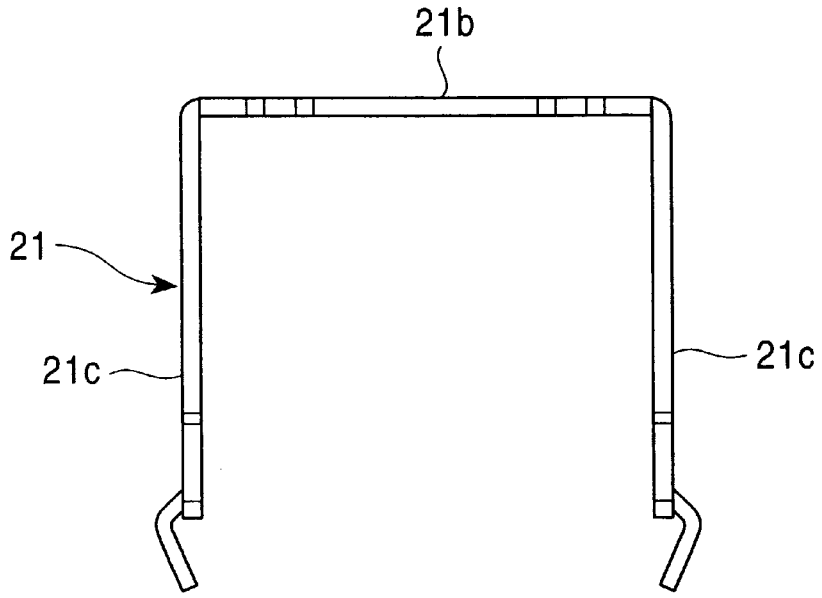
FIG. 25 is a front view of the mounting plate of the multiple operation type electrical part in accordance with the present invention.
Figure 26:
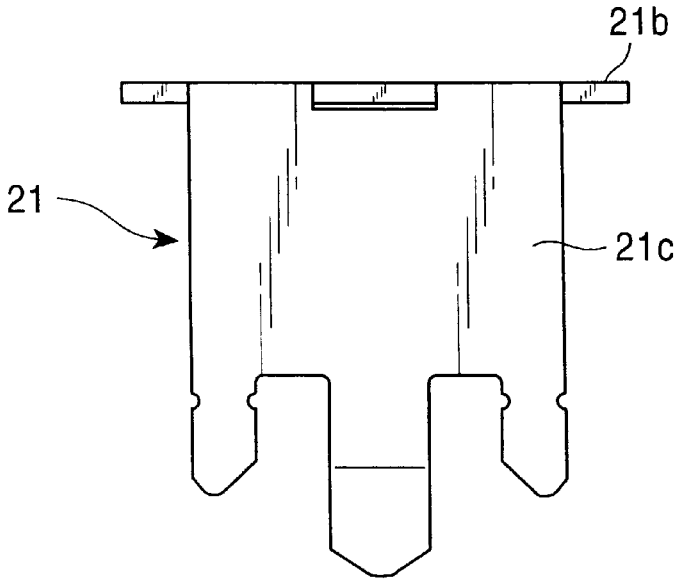
FIG. 26 is a side view of the mounting plate of the multiple operation type electrical part in accordance with the present invention.
Figure 27:
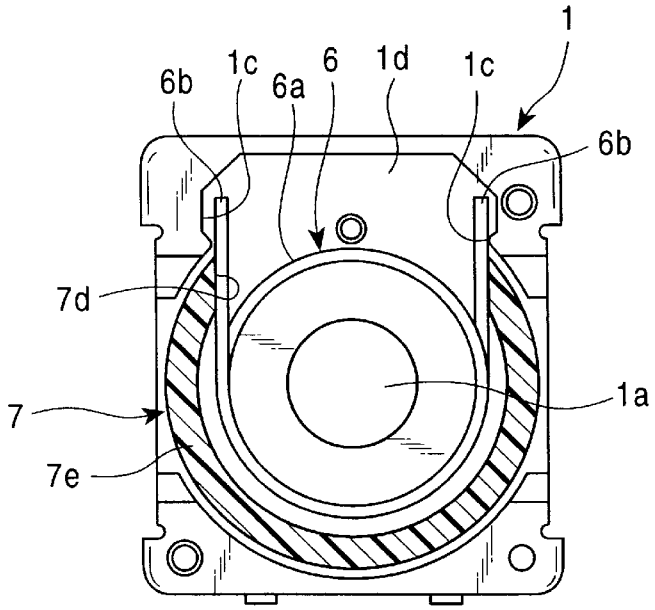
FIG. 27 is a view taken along line 27—27 of FIG. 1, illustrating the mounted state of the coil spring.
Figure 28:
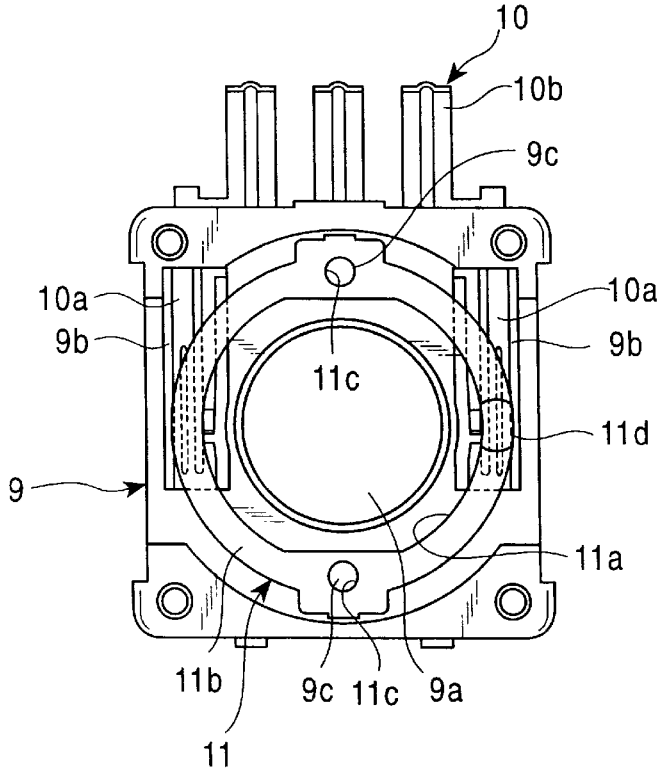
FIG. 28 is a view taken along line 28—28, illustrating the mounted state of the clicking member.

A description will now be given of embodiments of the multiple operation type electrical part of the present invention with reference to FIGS. 1 to 29. FIG. 1 is a sectional view of the multiple operation type electrical part in accordance with the present invention. FIGS. 2 to 4 illustrate the bearing. FIGS. 5 to 8 illustrate the linking member. FIGS. 9 and 10 illustrate the self-returning coil spring. FIGS. 11 to 13 illustrate the rotary member. FIGS. 14 to 16 illustrate the insulating base member. FIGS. 17 and 18 illustrate the second rotary member. FIGS. 19 and 20 illustrate the actuating member. FIGS. 21 to 23 illustrate the insulating base portion. FIGS. 24 to 26 illustrate the mounting member. FIG. 27 is a view taken along line 27—27 of FIG. 1, illustrating the mounted state of the coil spring. FIG. 28 is a view taken along line 28—28 of FIG. 1, illustrating the mounted state of the clicking member.

A description will now be given of an embodiment of the multiple operation type electrical part in accordance with the present invention with reference to FIGS. 1 to 28. As shown in FIGS. 2 to 4, and FIG. 27, the bearing 1, which is a metallic die casting or a molded product of synthetic resin, has a cylindrical portion 1*b* and a rectangular flange 1*e*. The cylindrical portion 1*b* has formed therein an insertion hole 1*a*, formed so as to have a portion with a small diameter and a portion with a large diameter. A recessed accommodating portion 1*d* having a pair of side walls 1*c* provided thereat is formed at the flange 1*e*. The flange 1*e* is formed behind the cylindrical portion 1*b*.

As shown in FIG. 1, the cylindrical outer shaft 2, formed of a metallic material such as brass, has an insertion hole 2*d* at the center portion thereof, a relatively large diameter operating portion 2*a*, an axial portion 2*b* having a smaller diameter than the operating portion 2*a*, and a mounting portion 2*c* provided at one end of the axial portion 2*b*. The axial portion 2*b* of the outer shaft 2 is inserted into the insertion hole 1*a* of the bearing 1 such that the outer shaft 2 can rotate therein.

As shown in FIGS. 5 to 8, the cylindrical linking member 3, which is a metallic die casting or a molded product of synthetic resin, has a non-circular hole 3*a* provided at the front center portion thereof; a recess 3*b* formed behind the hole 3*a* so as to be connected thereto and being larger than the hole 3*a*; a step 3*c* formed at the inner wall defining the recess 3*b*; a protruding mounting portion 3*e* provided at a stepped wall 3*d* formed between the recess 3*b* and the hole 3*a*; and a pair of protrusions 3*f* protruding rearward in a diametrical direction thereof.

As shown in FIG. 1, the linking member 3 is inserted into the insertion hole 1 of the bearing 1, and the axial portion 2*b* of the outer shaft 2 is inserted into the hole 3*a* of the linking member 3. The mounting portion 2*c*, provided at one end of the axial portion 2*b*, is caulked and retained by the bottom wall 3*d*. The mounting portion 3*e* of the linking member 3 is held by the mounting portion 2*c* provided at the axial portion 2*b* in order to join the linking member 3 and the outer shaft 2, thereby forming a joint portion of the linking member 3 and the outer shaft 2.

The linking member 3, joined to the outer shaft 2, can rotate without slipping as the outer shaft 2 rotates.

As shown in FIG. 1, the inner shaft 4, formed of a metallic material such as aluminum, has a large diameter operating portion 4*a*, an axial portion 4*b* with a smaller diameter than the operating portion 4*a*, a forked mounting portion 4*c* provided at one end of the axial portion 4*b*, and a groove portion 4*d* provided at the base of the mounting portion 4*c* and at the outer periphery of the axial portion 4*b*.

The axial portion 4*b* of the inner shaft 4 is inserted into the through hole 2*d* of the outer shaft 2 such that the mounting portion 4*c* and the groove portion 4*d* project from the rear side of the insertion hole 2*d*, whereby the mounting portion 4*c* and the groove portion 4*d* are positioned in the recess 3*b* of the linking member 3.

A C-shaped dislodgment preventing member 5, formed of metal, is formed at the groove portion 4*d*. When the inner shaft 4 is moved forward, the dislodgment preventing member 5 comes into contact with the step 3*c*, provided at the inner wall of the recess 3*b* of the linking member 3, in order to prevent the inner shaft 4 from being dislodged towards the front by using the space in the recess 3*b*.

The inner shaft 4, mounted to the outer shaft 2 in this manner, can rotate and move in the axial direction thereof.

The portion where the dislodgment preventing member 5 contacts the linking member 3 is located behind the portion where the linking member 3 and the outer shaft 2 are joined together, thereby facilitating the mounting of the outer shaft 2 and the inner shaft 4, and reducing the size of the electrical part in a diametrical direction thereof.

As shown in FIGS. 9 and 10, the self-returning coil spring 6, formed of a metallic spring wire, has a wound portion 6*a*, and a pair of opposing arms 6*b* extended from both sides of the wound portion 6*a*. As shown in FIG. 1 and 27, with the wound portion 6*a* being accommodated in the accommodating portion 1*d* of the bearing 1, the pair of arms 6*b* are mounted to the side walls 1c so as to be in resilient contact therewith.

When the coil spring 6 is mounted to the bearing 1 in this manner, the linking member 3 is positioned in the wound portion 6*a* such that the outer periphery of the linking member 3 is surrounded by the wound portion 6*a*.

As shown in FIGS. 11 to 13, the circular rotary member portion 7, which is a molded product of synthetic resin such as acetal resin or glass-containing resin, has a hole 7*a* provided at the center thereof; a pair of notches 7*b* connected to the hole 7*a* and provided at opposing edges of the hole 7*a*; a movable contact 7*c* embedded in one side of the rotary member portion 7 so as to be exposed; a C-shaped protruding wall portion 7*e* provided at the other side of the rotary member portion 7 and having a cutout portion 7*d*.

As shown in FIGS. 1 and 27, the rotary member portion 7 is combined with the linking member 3 by fitting the protrusions 3*f* of the linking member 3 into the notches 7*b*. The rotary member portion 7 and the linking member 3 form a first rotary member 8.

In order to form the first rotary member 8, the rotary member portion 7 and the linking member 3 may be formed into an integral structure by embedding the linking member 3 into the rotary member portion 7, or by integrally molding them from synthetic resin.

When the rotary member portion 7 is combined with the linking member 3, the wound portion 6*a* of the coil spring 6 is accommodated within the C-shaped wall portion 7*e*, and the pair of arms 6*b* pass through the cutout portion 7*d* so as to extend outwardly therefrom.

Clockwise or counterclockwise rotation of the outer shaft 2 causes the linking member 3 and the rotary member portion 7, which together form the first rotary member 8, to rotate at the same time.

When the linking member 3 and the rotary member portion 7 rotate at the same time, at one end of the wall portion 7*e* in which the cutout portion 7*d* of the rotary member portion 7 is formed, one of the arms 6*b* of the coil spring 6 is moved in a direction opposite to the side wall 1*c* of the bearing 1 and in opposition to the resiliency of the coil spring 6. Thereafter, when the outer shaft 2 is released so that rotational force is no longer applied, the arm 6*b* bumps into the associated side wall 1*c* due to its resiliency and stops there, whereby the first rotary member 8 (formed by the rotary member portion 7 and the linking member 3) rotates until it returns to its original position. Therefore, the first rotary member 8 can return to its original state by itself.

As shown in FIGS. 14 to 16, the rectangular insulating base member 9, which is a molded product of synthetic resin, has a circular hole 9*a* provided at the center portion thereof; a pair of opposing rectangular openings 9*b* formed at both sides of the hole 9*a*; and protruding mounting portions 9*c* provided away from and between the pair of openings 9*b*.

The sliding member 10, formed of a springy metallic plate, has a contact portion 10*a* and a terminal portion 10*b*. The contact portion 10*a* of the sliding member 10 is positioned in the openings 9*b* of the insulating base member 9, and the terminal portion 10*b* of the sliding member 10 is embedded in the insulating base member 9 so as to protrude outwardly therefrom.

A jig (not shown) is inserted into the openings 9*b* from the rear side thereof. The contact portion 10*a* is formed such that a portion thereof protrudes from the front side of the insulating base member 9.

As shown in FIG. 28, the annular clicking member 11, formed of a springy metallic plate, has an annular portion 11*b* with a hole 11*a* at the center portion thereof; a pair of mounting portions or holes 11*c* provided in the annular portion 11*b* so as to oppose each other, with the hole 11*a* being formed therebetween; and a protrusion lid provided at the annular portion 11*b* so as to be disposed midway between the pair of mounting portions 11*c*.

The protruding mounting portions 9*c* of the insulating base member 9 are inserted through their respective mounting portions 11*c*, or holes, of the clicking member 11, and one of the ends of each mounting portion 9*c* is, for example, pressed so that it spreads outward, in order to mount the clicking member 11 to the insulating base member 9. When the mounted clicking member 11 is mounted, a portion thereof is disposed at one of the surface sides of the insulating base member 9 and another portion thereof is disposed at the opposite surface side of the insulating base member 9 from where the contact portions 10a of the sliding member 10 protrude.

It is to be noted that the mounting portions 9*c* may be formed as recesses. In this case the mounting portions 11*c* are formed as protrusions.

As shown in FIG. 1, with the contact portions 10*a* opposing the movable contact 7*c* of the movable member 7, the insulating base member 9 is disposed on the rear side of the flange 1*e* of the bearing 1. The insulating base member 9, at which the sliding member 10 is provided, and the first rotary member 8 form a first rotary electrical part D1.

When insulating base member 9 is disposed in this manner, the linking member 3 and the rotary member portion 7 are covered by the insulating base member 9, and the contact portions 10*a* of the sliding member 10 can come into contact with and separate from the movable contact 7*c*.

When the rotary member portion 7, forming the first rotary member 8, is rotated, the movable contact 7*c* rotates in order to come into contact with and separate from the contact portions 10*a*, whereby a switching operation is performed at the first rotary electrical part D1.

As shown in FIGS. 17 and 18, the second rotary member 12, which is a molded product of synthetic resin, has a disk-shaped portion 12*b* having a bumpy portion 12*a* formed at the front side thereof; an axial portion 12*c* integrally formed with the disk-shaped portion 12*b*; and a non-circular hole 12*d* formed in the center of the second rotary member 12 so as to extend along the disk-shaped portion 12*b* and the axial portion 12*c*.

The contact member 13, formed of a metallic plate and having a code pattern formed thereon, is embedded in the second rotary member 12, with its contact portion being exposed at the rear surface of the disk-shaped portion 12*b*.

As shown in FIG. 1, with the disk-shaped portion 12*b* being disposed at the rear side of the insulating member 9, the axial portion 12*c* of the second rotary member 12 having the above-described structure is inserted and guided through the hole 9*a* of the insulating base member 9 in order to rotatably mount the second rotary member 12 to the insulating base member 9.

The clicking member 11 is disposed between the second rotary member 12 and the insulating base member 9. When the protrusion 11*d* of the clicking member 11 engages the bumpy portion 12*a* of the second rotary member 12, and the second rotary member 12 is rotated, the protrusion 11*d* repeatedly engages and disengages the bumpy portion 12*a*, whereby a tactile feel is provided.

As shown in FIGS. 19 and 20, the actuating member 14, which is a molded product of synthetic resin, has a body portion 14*a*; a protruding portion 14*b* which protrudes forwardly from the center of the body portion 14*a*; recesses 14*c* provided on both sides of the protruding portion 14*b*; a pair of protruding linear portions 14*d* formed at both opposite outer sides of the body portions 14*a*; and a protrusion 14*e* at the rear side of the body portion 14*a*.

As shown in FIG. 1, the actuating member 14 is inserted into the hole 12*d* of the second rotary member 12 in order to join the protruding linear portions 14*d* to the edge of the hole 12*d* through splines.

The protruding portion 14*b* of the actuating member 14 is fitted to the space between the tines of the forked mounting portion 4*c* of the inner shaft 4, and the forked mounting portion 4*c* is fitted to the recesses 14*c* of the actuating member 14.

When the inner shaft 4 is rotated, the protruding portion 14*b* and the recesses 14*c* of the actuating member 14 are fitted to the inner shaft 4, so that the actuating member 14 rotates with the inner shaft 4, causing the second rotary member 12, joined through splines, to be rotated.

When the inner shaft 4 is moved rearward in the axial direction thereof, the actuating member 14 is pushed and moved rearward by the inner shaft 4 at the same time. In addition, the actuating member 14 slides within the second rotary member 12 as a result of being joined to the second rotary member 12 through splines.

As shown in FIGS. 21 to 23, the insulating case 15, which is a molded product of synthetic resin, has a side wall 15*b* with a recess 15*a* formed at the center and front side thereof; and a bottom wall 15*d* with a pair of rectangular openings 15*c* formed therein.

As shown in FIGS. 21 to 23, the contact member 16, formed of a springy metallic plate, has a contact portion 16*a* and a terminal portion 16*b*. The contact portion 16*a* of the contact member 16 is positioned in the rectangular openings 15*c* of the bottom wall 15*d*, while the terminal portion 16*b* is embedded in the insulating case 15 so as to protrude outward from the insulating case 15.

A jig (not shown) is inserted into the openings 15*c* from the rear side thereof, and the contact portions 16*a* are formed such that a portion thereof protrudes from the front side of the bottom wall 15*d*.

As shown in FIG. 1 and FIGS. 21 to 23, the contact member 17, formed of a metallic plate, has a contact portion 17*a* and a terminal portion 17*b*, while the contact member 18, also formed of a metallic plate, has a contact portion 18*a* and a terminal portion 18*b*. The contact members 17 and 18 are mounted to the insulating case 15 so as to be embedded therein.

With the contact portion 17*a* of the contact member 17 being exposed at the center portion of the bottom wall 15*d* of the insulating case 15, the contact member 17 is embedded in the insulating case 15. At the outer periphery of the contact portion 17*a*, while the contact portion 18*a* of the contact member 18 is exposed at the bottom wall 15*d*, the contact member 18 is mounted to the insulating case 15 so as to be embedded in the insulating case 15.

As shown in FIG. 1, the contact members 17 and 18 and the insulating case 15, having the contact member 16 embedded therein, are successively disposed on one another from the rear side of the insulating base member 9. When these component parts are disposed in this manner, the contact portions 16*a* of the contact member 16 can come into contact with and separate from the contact member 13. When the second rotary member 12 is rotated, the contact member 13 comes into contact with and separates from the contact member 16, whereby a switching operation is performed.

The insulating case 15, to which the contact member 16 is mounted, and the second rotary member 12, to which the contact member 13 is mounted, form a second rotary electrical part D2 serving as rotary encoder.

Although in the embodiment the contact member 13 is described as being mounted to the second rotary member 12, and the contact member 16 is described as being mounted to the insulating case 15, the contact member 16 may be mounted to the second rotary member 12, and the contact member 13 may be mounted to the insulating case 15.

In the second rotary electrical part D2, the second rotary member 12 may have a resistor, and the insulating case 15 may be provided with a rotary variable resistor having mounted thereto a sliding piece which slidably contacts the resistor.

As shown in FIG. 1, the movable contact 19, formed of a springy metallic plate, is dish-like in shape and has a concavely formed center portion. The movable contact 19 is accommodated in the recess 15*a* of the insulating case 15. The center portion of the movable contact 19 is separated from the contact member 17, and the peripheral portions of the movable contact 19 are mounted to the contact member 18 so as to be normally in contact therewith.

As shown in FIG. 1, when the insulating case 15 is disposed on the rear side of the insulating base member 9, the center portion of the movable contact 19 is in contact with the actuating member 14. The resiliency of the movable contact 19 causes the actuating member 14 and the inner shaft 4 to be normally pushed towards the front, so that the dislodgment preventing member 5 is pushed against the step 3*c* of the linking member 3.

When the inner shaft 4 is pushed rearwards in the axial direction thereof, causing the actuating member 14 to move in the same direction, the center portion of the movable contact 19 is pushed in opposition to its resiliency by the actuating member 14, and comes into contact with the contact member 17. This renders the contact members 17 and 18 conductive, whereby a push switch S is turned on. When the inner shaft 4 is released, the resiliency of the movable contact 19 causes the actuating member 14 and the inner shaft 4 to return to their original positions. This causes the movable contact 19 to separate from the contact member 17, whereby the push switch S is turned off.

The case 15, to which the contact members 17 and 18 are mounted, and the movable contact 19 form the push switch S.

As shown in FIG. 10, the cover 20, which is a molded product of synthetic resin, is plate-like in shape. It is disposed on the rear side of the insulating case 15 in order to prevent entry of dust or the like into the insulating case 15 from the hole 15*c* of the insulating case 15.

As shown in FIGS. 24 to 26, the mounting plate 21, formed by punching out and bending into a U shape a metallic plate, has front plate portion 21*b* with a hole 21*a* formed therein; and a pair of mounting legs 21*c* formed by bending portions of the mounting plate 21 rearward from the front plate portion 21*b*.

As shown in FIG. 1, the outer shaft 2 and the cylindrical portion 1*b* of the bearing 1 are inserted into the hole 21*a* of the mounting plate 21. The front plate portion 21*b* is mounted on the front side of the flange 1*e* of the bearing 1. The flange 1*e*, the insulating base member 9, the insulating case 15, and a side portion of the cover 20, which are supported by the mounting legs 21*c*, are retained by the back surface of the cover 21 by bending one end of each mounting leg 21*c*.

The multiple operation type electrical part having the above-described structure is assembled by successively disposing the bearing 1, the insulating base member 9, the insulating case 15, and the cover 20, which are formed into an integral structure by the mounting plate 21.

A description will now be given of the operation of the multiple operation type electrical part having the above-described structure. In FIG. 1, clockwise or counterclockwise rotation of the outer shaft 2 causes simultaneous rotation of the linking member 3 and the rotary member portion 7, both of which together form the first rotary member 8.

The rotary member portion 7 rotates against the resiliency of the arm 6*b* of the coil spring 6. The movable contact 7*c* rotates and comes into contact with and separates from the contact portions 10*a*, whereby switching operations are performed at the first rotary electrical part D1.

When the outer shaft 2 is released so that rotational force is no longer applied thereto, the arm 6*b*, which has been moved, causes the first rotary member 8 (the rotary member portion 7 and the linking member 3) to return to its original position and switching state. The first rotary member 8, the linking member 3, and the outer shaft 2 are self-returning component parts capable of returning to their original positions by themselves.

Clockwise or counterclockwise rotation of the inner shaft 4 causes rotation of the second rotary member 12 through the actuating member 14 to which the inner shaft 4 is joined.

Here, the bumpy portion 12*a* of the second rotary member 12 engages and disengages the clicking member 11 to provide a tactile feel when the second rotary member 12 is rotated. The contact member 13, provided at the second rotary member 12, rotates in order to come into contact with and separate from the sliding member 16. This results in switching operations at the second rotary electrical part D2.

When the inner shaft 4 is pushed rearward in the axial direction thereof, the actuating member 14 moves in the same direction to push the center portion of the movable contact 19 in opposition to the resiliency of the movable contact 19. This causes the center portion of the movable contact 19 to come into contact with the contact member 17, thereby rendering the contact members 17 and 18 conductive, and turning on the push switch S.

When the inner shaft 4 is released, the resiliency of the movable contact 19 causes the actuating member 14 and the inner shaft 4 to return to their original positions. This causes the movable contact 19 to separate from the contact member 17 and the push switch S to be turned off.

Thus, the multiple operation type electrical part is operated in the above-described way.

The multiple operation type electrical part having the above-described structure is used in operating a car stereo. More specifically, the first rotary electrical part D1 is used for radio tuning. The second rotary electrical part D2 is used, for example, for volume or bass adjustments. The push switch S is used for switching, for example, volume or bass modes.

Figure 29:
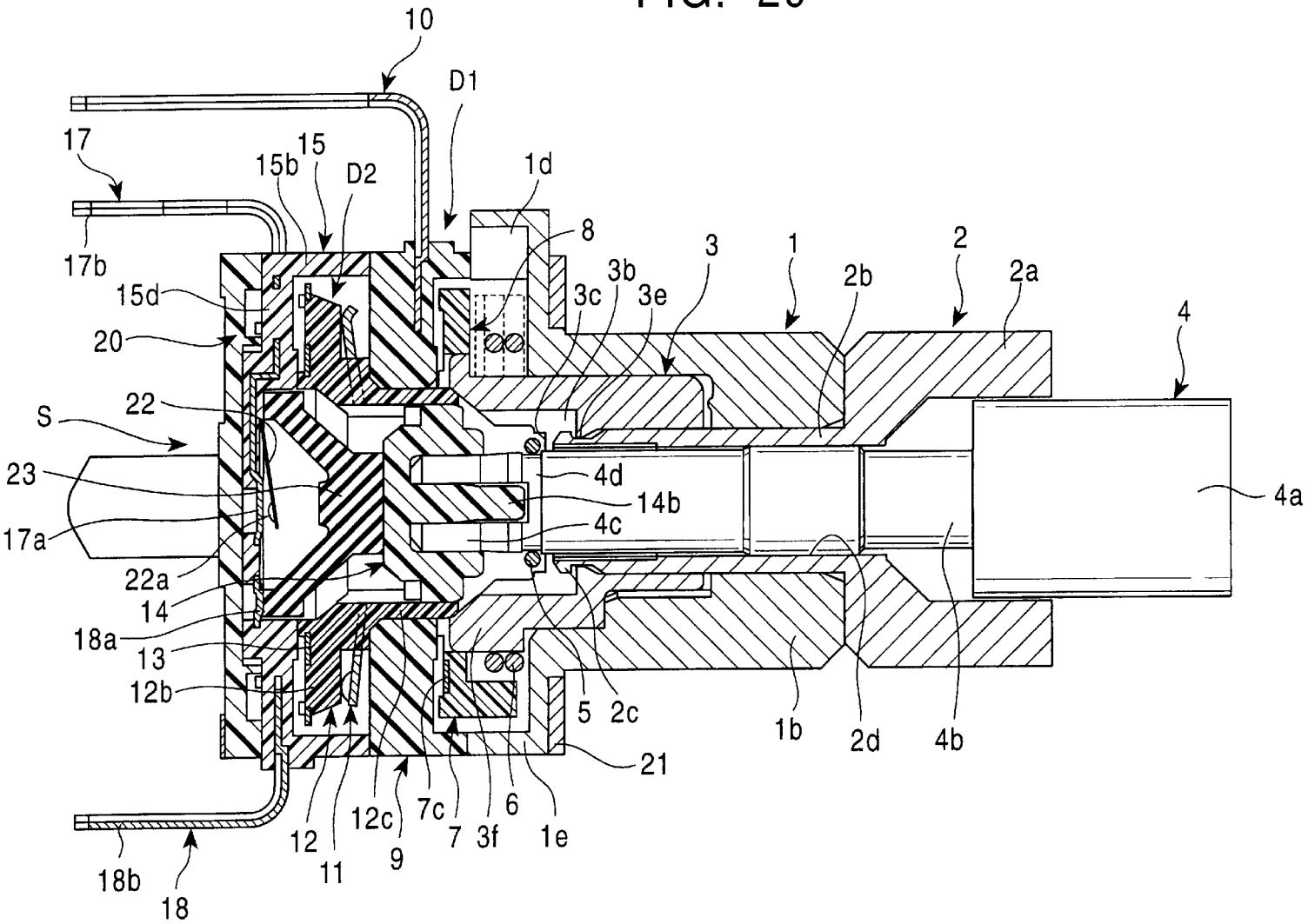
FIG. 29 is a sectional view of another embodiment of the multiple operation type electrical part in accordance with the present invention.
Figure 30:
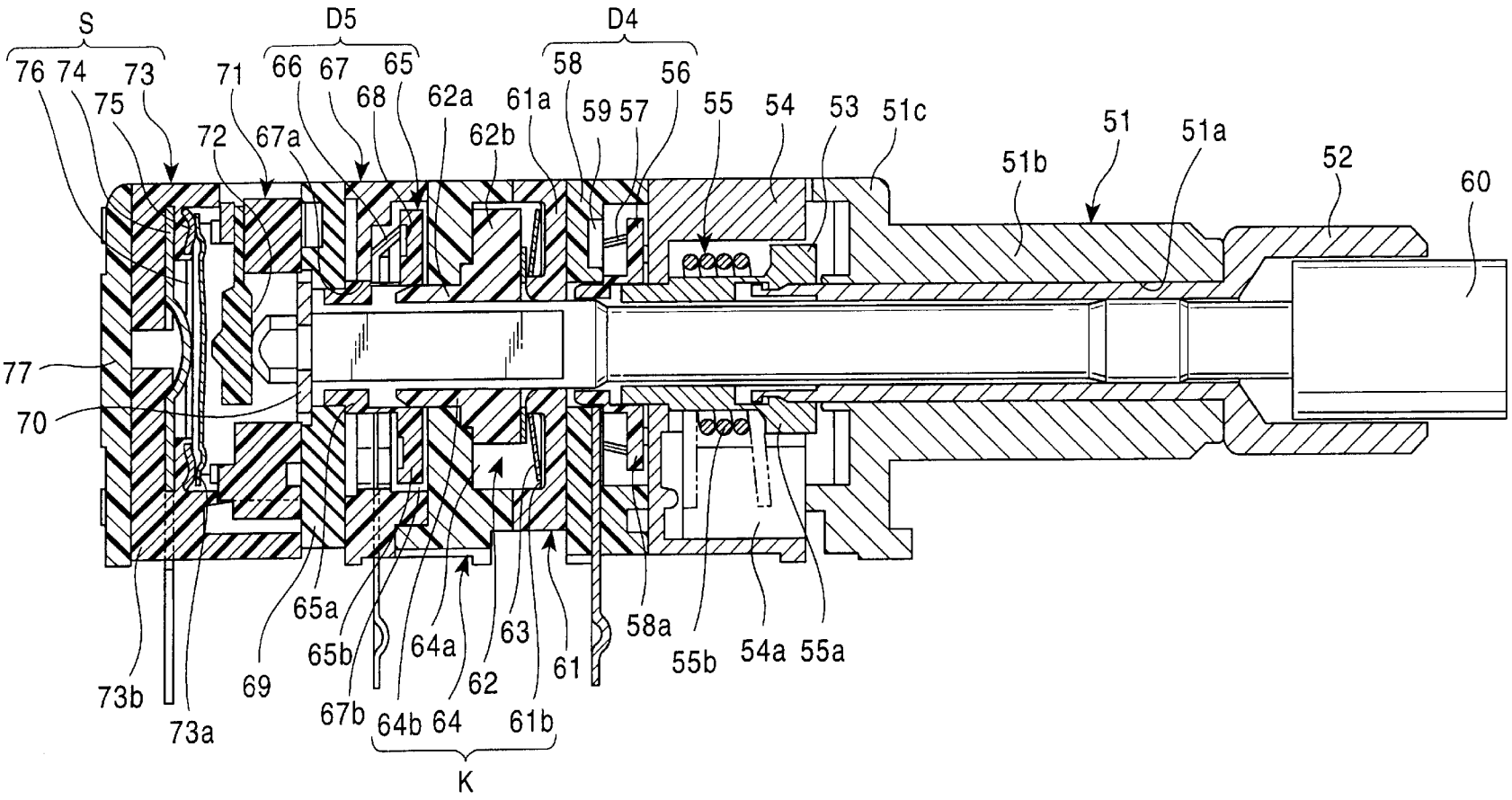
FIG. 30 PRIOR ART
FIG. 30 is a sectional view of a conventional operation type electrical part in accordance with the present invention.

FIG. 29 illustrates another embodiment of the multiple operation type electrical part in accordance with the present invention. A movable contact 22 and a dome-shaped, rubber movable member 23 are disposed in the insulating case 15. The movable contact 22 has a contact portion 22*a* formed by cutting a portion of the movable contact 22 so as to be raised. The peripheral portions of the movable contact 22 are in contact with a contact member 18. When the actuating member 14 is moved in the axial direction by the inner shaft 4, the actuating member 14 pushes and deforms the movable member 23. The movable member 23 causes the contact portion 22*a* to come into contact with the contact portion 17*a* of a contact member 17, whereby the contact members 17 and 18 are rendered conductive. When the inner shaft 4 is released, the contact portion 22*a* returns to its original state due to its resiliency, and the contact members 17 and 18 are brought out of conduction. The movable member 23 also returns to its original state due to its resiliency, causing the actuating member 14 and the inner shaft 4 to move back to their original positions.

In this structure, the same reference numerals as those used in the figures illustrating the structure of the electrical part of the previous embodiment are used to denote parts or component parts which are the same as or equivalent to those of the previous embodiment.

According to the invention, dislodgment of the inner shaft 4 is prevented by using the space of the recess 3*b* at the center portion of the first rotary member 8. Therefore, it is possible to provide a multiple operation type electrical part which is small in the axial direction, and having a very small overall size.

In addition, the dislodgment preventing member 5, mounted to the inner shaft 4, is formed so as to be in contact with the inner wall defining the recess 3*b* of the first rotary member 8. There, it is possible to provide a multiple operation type electrical part which is small and has a simple structure.

The portion where the outer shaft 2 and the first rotary member 8 are joined is positioned in front of the portion where the dislodgment preventing member 5 and the inner wall contact each other. Therefore, it is possible to provide a multiple operation type electrical part which can facilitate the joining of the outer shaft 2 and the first rotary member 8, and the mounting of the dislodgment preventing member 5.

The outer shaft 2 is retained by the bottom wall 3*d* formed at the recess 3*b* of the first rotary member 8 in order to join the first rotary member 8 and the outer shaft 2. Therefore, it is possible to provide a multiple operation type electrical which has a simple structure, which can facilitate the joining operation, and which provides high productivity.

The first rotary member 8 is formed by the rotary member portion 7 and the linking member 3, and dislodgment of the inner shaft 4 is prevented by using the space of the recess 3*b* of the linking member 3. Therefore, it is possible to provide a multiple operation type electrical part which can prevent the inner shaft 4 from being dislodged by using the space within the linking member 3, and which is small in the axial direction.

The arm 6*b* of the self-returning coil spring 6 are moved by the rotary member portion 7 forming the first rotary-member 8. Therefore, it is possible to provide a small multiple operation type electrical part which can be assembled more easily.

What is claimed is:

1. A multiple operation type electrical part comprising:

a rotatable cylindrical outer shaft;

a rotatable inner shaft inserted in the outer shaft, the inner shaft being movable in an axial direction thereof;

a first rotary electrical part comprising a first rotary member actuated by the rotational motion of the outer shaft, the first rotary member having a center portion;

a second rotary electrical part comprising a second rotary member actuated by the rotational motion of the inner shaft;

a push switch operated by the axial movement of the inner shaft;

a dislodgment preventing member mounted to the inner shaft; and wherein the center portion of the first rotary member has a recess for inserting the inner shaft therein; and wherein contact between an inner wall of the recess and the dislodgment preventing member prevents dislodgment of the inner shaft in a front axial direction.

2. A multiple operation type electrical part according to claim 1, wherein the first rotary member is coupled to the outer shaft laterally away from an inner wall portion that makes contact with the dislodgment preventing member.

3. A multiple operation type electrical part according to claim 2, wherein the first rotary member has a stepped bottom wall formed at an insertion hole connected to the recess and extending in an axial direction thereof, bottom wall being coupled to the outer shaft.

4. A multiple operation type electrical part according to claim 3, wherein the first rotary member comprises a movable contact and a linking member positioned within the recess, the linking member being coupled to the outer shaft.

5. A multiple operation type electrical part according to claim 4, further comprising a self-returning coil spring provided at an outer periphery of the linking member, the coil spring having an arm which is moved by the first rotary member in order to cause the outer shaft to return to an original position by the coil spring.

* * * * *